US007293631B2

(12) United States Patent
Ishii et al.

(10) Patent No.: US 7,293,631 B2
(45) Date of Patent: Nov. 13, 2007

(54) MACHINE ROOM-LESS ELEVATOR

(75) Inventors: Takashi Ishii, Matsudo (JP); Hiroshi Sano, Fuchu (JP); Kan Kawasaki, Mitaka (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 314 days.

(21) Appl. No.: 10/480,647

(22) PCT Filed: Apr. 11, 2003

(86) PCT No.: PCT/JP03/04656

§ 371 (c)(1),
(2), (4) Date: Dec. 29, 2003

(87) PCT Pub. No.: WO03/091143

PCT Pub. Date: Nov. 6, 2003

(65) Prior Publication Data

US 2004/0182651 A1 Sep. 23, 2004

(30) Foreign Application Priority Data

Apr. 26, 2002 (JP) ..... 2002-127231
Apr. 30, 2002 (JP) ..... 2002-129164

(51) Int. Cl.
*B66B 11/02* (2006.01)
*B66B 9/02* (2006.01)

(52) U.S. Cl. ..... 187/401; 187/250; 187/254

(58) Field of Classification Search ..... 187/254, 187/401, 250
See application file for complete search history.

(56) References Cited

U.S. PATENT DOCUMENTS

| | | | | |
|---|---|---|---|---|
| 5,429,211 | A * | 7/1995 | Aulanko et al. | 187/254 |
| 5,469,937 | A * | 11/1995 | Hakala et al. | 187/266 |
| 6,085,874 | A * | 7/2000 | Uchino et al. | 187/404 |
| 6,234,276 | B1 * | 5/2001 | Wagatsuma et al. | 187/411 |
| 6,626,266 | B2 * | 9/2003 | Hamaguchi | 187/266 |
| 6,848,543 | B2 * | 2/2005 | Adifon et al. | 187/254 |
| 2004/0206580 | A1 * | 10/2004 | Ishii et al. | 187/264 |

FOREIGN PATENT DOCUMENTS

| | | |
|---|---|---|
| JP | 2664619 | 6/1997 |
| JP | 11-139717 | 5/1999 |
| JP | 2000-318947 | 11/2000 |
| JP | 2000-318948 | 11/2000 |
| JP | 2001-122564 | 5/2001 |
| JP | 2001-171953 | 6/2001 |
| JP | 2002-504469 | 2/2002 |

* cited by examiner

*Primary Examiner*—Terrell Matthews
(74) *Attorney, Agent, or Firm*—Oblon, Spivak, McClelland, Maier & Neustadt, P.C.

(57) ABSTRACT

There is provided an machineroom-less elevator which can reduce the pit depth in a bottom part of an elevator shaft, mostly perform maintenance work on an upper space of a cage, and reduce a top clearance. A pair of right and left cage-side sheaves are disposed in the upper space of the cage, and the rotational axes of the traction sheave and the cage-side sheaves are extended in the longitudinal direction. A sheave supporting beam to rotatably support cage-side sheaves is disposed in a space between and upper beam of the cage frame and a ceiling of the cage, and disposed below rotary shafts of the cage-side sheaves.

9 Claims, 8 Drawing Sheets

(b)

(a)

MACHINE ROOM-LESS ELEVATOR

BACKGROUND OF THE INVENTION

1. Field of the Invention

The present invention relates to a machine room-less elevator having no machine room disposed above an elevator shaft provided in a building.

2. Description of the Related Art

Various machine room-less elevators having no machine room disposed above an elevator shaft have been developed and proposed for efficiently utilizing spaces in buildings and for observing regulations regarding the right to sunlight.

For example, in a conventional machine room-less elevator shown in FIGS. 7 and 8, a driving unit 3 is fixed to a top wall surface 2 of the elevator shaft in which a cage 1 is adapted to move vertically, and a hoist cable 5 including a plurality of small diameter ropes is wound around a traction sheave 4 rotationally driven by the driving unit 3.

A portion of the hoist cable 5 extending downwardly from the traction sheave 4 toward the cage 1 comprises a portion 5*a* extending downwardly along a left side wall 1*a* of the cage 1, a portion 5*b* horizontally extending between a pair of right and left cage-side sheaves 1*c* and 1*b* rotatably supported by a lower part of the cage 1, and a portion 5*c* extending upwardly along a right sidewall 1*d* of the cage 1 and fixed to a hitching device 6 provided in the top space of the elevator shaft. Thus, an one end of the hoist cable 5 suspends the cage 1 in a two-to-one roping arrangement.

Similarly, a portion of the hoist cable 5 extending downwardly from the traction sheave 4 toward a counterweight 7 comprises a portion extending downwardly along the sidewall 2 of the elevator shaft, a portion wound around a counterweight-side sheave 7*a* rotatably supported by an upper part of the counterweight 7, and a portion extending upwardly from the counterweight-side sheave 7*a* and fixed to a hitching device (not shown) provided in the top space above the elevator shaft. Thus, another end of the hoist cable 5 suspends the counterweight 7 in a two-to-one roping arrangement.

In a conventional machine room-less elevator shown in FIGS. 7 and 8, since the cage-side sheaves 1*b* and 1*c* are provided under the cage, the depth of a pit provided in the bottom of the elevator shaft becomes deep inevitably.

In addition, since the hoist cable 5 is extending vertically along the right and left side walls 1*a* and 1*d* of the cage 1, the width "L" of the elevator shaft in the right-to-left direction becomes large to secure enough width "W1" of the cage 1 in the right-and-left direction (the door opening/closing direction).

In other words, provided that the dimension "L" of the elevator shaft cross section in the right-to-left direction is set at a specified value, the dimension "W1" in the right-to-left direction of the cage 1 become small inevitably.

In addition, the maintenance of the driving unit 3, the traction sheave 4 and a control device 8 fixed to the top side wall of the elevator shaft must be performed by an operator riding on the cage 1 stopped in the highest position of the elevator shaft.

Contrary to this, the maintenance of the cage-side sheaves 1*b* and 1*c* must be performed in the pit during the time when cage 1 is stopped in the lowest position of the elevator shaft.

Accordingly, in the above-mentioned conventional machine room-less elevator, the maintenance work cannot be efficiently performed.

SUMMARY OF THE INVENTION

It is an object of the present invention to provide an improved machine room-less elevator capable of solving the above-mentioned problems in the prior art, of reducing the pit depth of an elevator shaft, of efficiently performing the maintenance work on an cage, and of reducing the top clearance in the a vertical direction between the ceiling of the elevator shaft and the cage stopped in the highest position of the elevator shaft.

According to a first aspect of the present invention, a machine room-less elevator comprises:

a cage adapted to move vertically in an elevator shaft;

a traction sheave disposed within the elevator shaft and rotationally driven around a rotational axis extending back and forth direction;

a driving unit for rotating the traction sheave;

one or more cage-side sheaves supported above the cage and rotatable around rotational axis extending parallel to or in a close relation to the rotational axis of the traction sheave; and a hoist cable including a plurality of ropes wound around the traction sheave, said cage being suspended by one end of thereof and a counterweight being suspended by another end thereof through a cage-side sheave.

The back and forth direction is not limited to the direction perpendicular to the cage door opening/closing direction (the right-to-left direction), but includes the direction close to the direction perpendicular to the cage door opening/closing direction.

In the machine room-less elevator according to the first aspect of the present invention, since the cage-side sheaves are provided above the cage, the depth of the pit in the bottom of the elevator shaft can be reduced.

In addition, the maintenance of the traction sheave, the cage-side sheaves, the driving unit and a control device or the like to control the driving unit can be intensively performed by an operator riding on the cage.

Further, since the hoist cable does not extend along the right and left side walls of the cage, a wider space for the cage can be secured provided that the dimension of the horizontal cross section of the elevator shaft is set at a specified value. In other words, the dimension of the horizontal cross section of the elevator shaft can be further reduced provided that the dimension of the horizontal cross section of the cage is set at a specified value.

Still further, since the rotational axis of the cage-side sheaves extend parallel to the rotational axis of the traction sheave each other, or the rotational axes of the cage-side sheaves extend in a direction close to a direction in which the rotational axis of the traction sheave extends, the angle formed by these axes can be preferably in a range of 0° to 45°, more preferably in a range of 0° to 30°, and most preferably in a range of 0° to 15°. As a result, the torsion of the hoist cable generated in the portion of the hoist cable extending between the traction sheave and the cage-side sheaves can be minimized.

Accordingly, even when the cage moves to the highest position in the hoistway and the vertical space between the traction sheave and the cage-side sheaves becomes minimum, the angle between ropes of the hoist cable and the grooves of the traction sheave is kept small. As a result, the noise and vibrations caused by the contact between the ropes and the grooves can be prevented.

In addition, since neither cage-side sheaves nor hoist cable is disposed below the cage, a buffer for receiving the cage in case of emergency can be provided in the bottom of the elevator shaft so that it faces the center of the bottom of the cage viewed vertically.

According to the second aspect of the present invention, the cage-side sheaves are right and left cage-side sheaves which are disposed in the vicinity of right and left side walls of the cage respectively and rotationally driven around the rotational axes parallel each other.

This means that, in the machine room-less elevator according to the second aspect of the present invention, any one of the cage-side sheaves can be disposed immediately below or in the vicinity of the traction sheave.

Since no diverting sheave needs to be interposed between the traction sheave and the cage-side sheaves, the space between the ceiling of the elevator shaft and the cage, so-called the top clearance, can be reduced.

In addition, since the contact angle of the hoist cable to the traction sheave can be set to a large value, the hoist cable can reliably engage the traction sheave with large friction.

According to a third aspect of the present invention, the cage-side sheaves are disposed in a projected area of the cage when viewed vertically in the elevator shaft.

This means that, in the machine room-less elevator according to the third aspect of the present invention, a large space for the cage can be obtained by bringing the side walls of the cage close to an inner wall surface of the elevator shaft, when the horizontal cross section of the elevator shaft is set at a specified value.

In other words, the horizontal cross section of the elevator shaft can be further reduced when the horizontal cross section of the cage is set at a specified value.

According to a fourth aspect of the present invention, the right and left cage-side sheaves are disposed symmetrically about the center of gravity of the cage when viewed in a vertical direction.

In this context, the position of the center of gravity of the cage is the position defined in a cage design under no passenger condition.

This means that, since the force of gravity acting on the cage and the force for hoisting the cage upwardly are aligned substantially in the horizontal direction, the cage can be stably suspended.

According to a fifth aspect of the present invention, the machine room-less elevator further comprises:

a cage frame for supporting said cage, said cage frame having an upper beam extending horizontally above the cage; and a sheave supporting beam for rotatably supporting said right and left cage-side sheaves at each ends thereof, said sheave supporting beam being connected at a longitudinal center portion of an upper surface thereof to a longitudinal center portion of a lower surface of the upper beam, and said sheave supporting beam having means for supporting the rotational axes of said pair of right and left cage-side sheaves above said upper surface thereof.

This means that, since the sheave supporting beam can be disposed below the rotational axes of the cage-side sheaves, the upper beam can be disposed closer to the upper surface of the cage.

As a result, the vertical space between the ceiling of the elevator shaft and the top portion of the cage, so-called a top clearance, can be further reduced.

In addition, the force for hoisting the cage upwardly which is applied to the cage-side sheaves can be transmitted directly to the lower surface of the upper beam through the upper surface of the sheave supporting beam.

According to a sixth aspect of the present invention, the machineroom-less elevator according to the fifth aspect of the present invention further comprises:

a pair of right and left cage guide rails; and guide units for guiding a vertical movement of the cage by contacts with said pair of guide rails, said guide units being fixed to an upper portion of the cage frame, wherein said cage frame has at least one pair of front and back members extending vertically along the guide rails and disposed so that on of the guide rails is interposed between the pair of front and back members in back and forth direction, and said guide units being disposed between the pair of front and back members in an area between the lower surface of the upper beam and the upper surface of the cage.

This means that, in the machine room-less elevator according to the sixth aspect of the present invention, since the guide unit is disposed below the upper beam of the cage frame, the cage can moves up to the highest position in the vicinity of the top end of the cage-side guide rails.

Accordingly, the vertical space between the ceiling of the elevator shaft and the top portion of the cage, the so-called top clearance, can be further reduced.

According to a seventh aspect of the present invention, at least a part of the driving unit overlaps the projected area of the cage when viewed vertically.

This means that, since at least a part of the driving unit is disposed above the cage, a space required for the driving unit to drive rotationally the traction sheave can be secured.

In addition, since the side wall of the cage disposed below the driving unit can be brought close to an inner wall of the elevator shaft, a larger space for the cage can be secured when the horizontal cross section of the elevator shaft is set at a specified value.

In other words, the dimension of the horizontal cross section of the elevator shaft can be further reduced when the dimension of the horizontal cross section of the cage is set at a predetermined value.

According to an eighth aspect of the present invention, the machine room-less elevator according to the seventh aspect of the present invention further comprises:

a counterweight suspended by the other end of the hoist cable;

a pair of back and forth counterweight-side guide rails for guiding the vertical movement of the counterweight; and a supporting frame bridged between the top ends of the pair of back and forth counterweight-side guide rails and horizontally extending in a back and forth direction, said supporting frame having a pair of upper and lower horizontal walls and a vertical wall extending therebetween, wherein said driving unit is disposed and fixed on the upper surface of the supporting frame and on the top end of the cage-side guide rail disposed in the vicinity of the counterweight-side guide rails.

This means that, since the cage-side guide rail can extend higher than the counterweight-side guide rails by the vertical dimension of the supporting frame, the cage can move higher toward the ceiling of the elevator shaft along the cage-side guide rails.

In addition, the driving unit can be stably supported by the two counterweight-side guide rails and one cage-side guide rail.

According to a ninth aspect of the present invention, the driving unit is disposed so that the center of gravity thereof is above the position disposed closer to the cage-side guide rail than a back side of the vertical wall of the supporting frame.

This means that, the bending moment around the axis extending in the longitudinal direction of the supporting frame caused by the weight of the driving unit is not applied to the supporting frame.

Accordingly, the two counterweight-side guide rails and the one cage-side guide rail are not bent by the weight of the driving unit.

According to a tenth aspect of the present invention, the other end of the hoist cable is fixed to the hitching device which is continuously provided to the supporting frame.

This means that, since a total of three guide rails support the tensional force applied by the other end of the hoist cable, bending of each guide rail can be minimized.

According to an eleventh aspect of the present invention, the machine room-less elevator comprises:

a cage adapted to move vertically in an elevator shaft;

a cage-side sheave provided above the cage;

a driving unit disposed in the elevator shaft and generating the driving force for moving the cage vertically;

a counterweight adapted to move vertically in the elevator shaft; and a hoist cable wound around the driving unit and adapted to suspend said cage-side sheave with one end thereof and suspend the counterweight with another end thereof.

This means that, in the machine room-less elevator according to the eleventh aspect of the present invention, the driving unit, the sheaves and guide rails to support the cage, or the like can be freely disposed within the elevator shaft, and in addition, the pit depth in the bottom part of the elevator shaft can be reduced.

DESCRIPTION OF THE PREFERRED EMBODIMENTS

Figure 1:
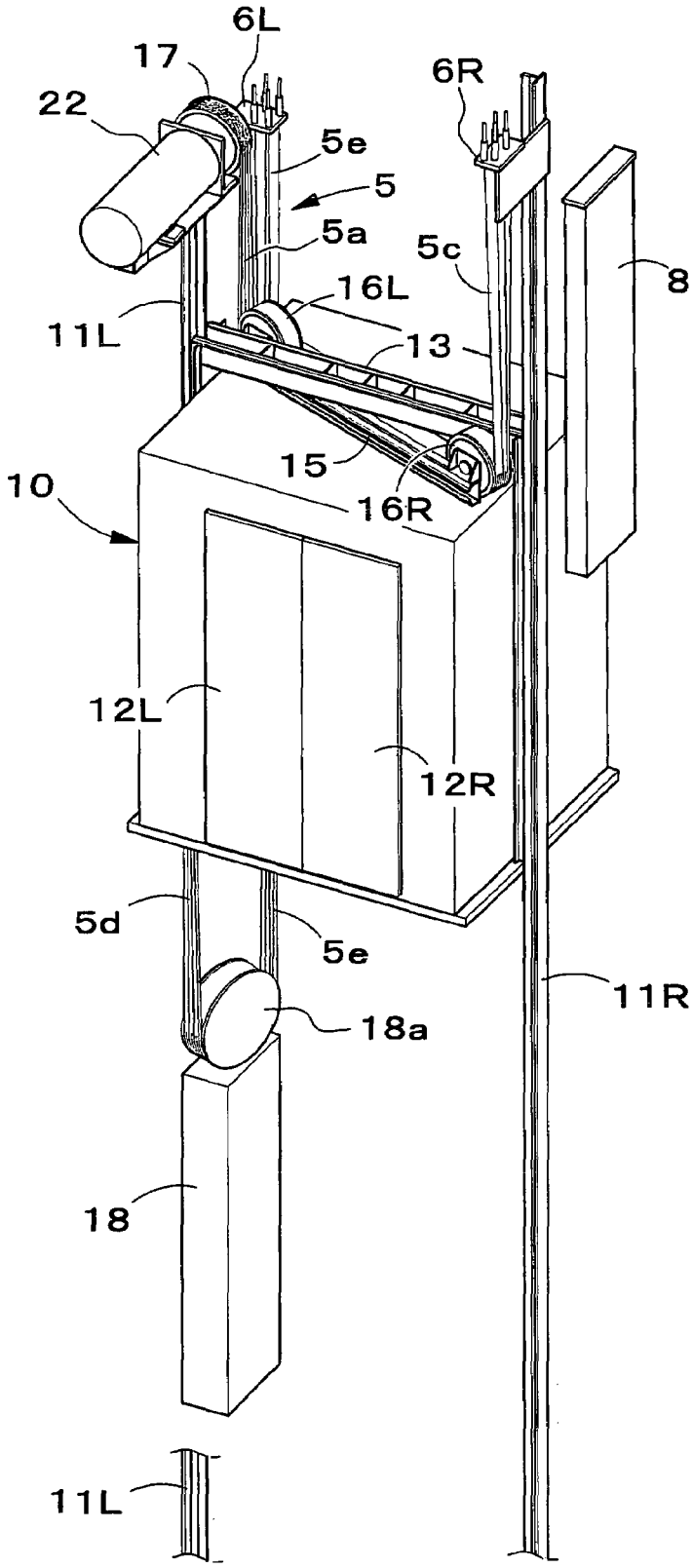
FIG. 1 is a perspective view of an machineroom-less elevator according to an embodiment of the present invention.

Embodiments of a machine room-less elevator according to an embodiment of the present invention will be described below with reference to FIGS. 1 to 8.

In the description below, the right-and-left direction is defined as the direction in which an entrance door of a cage is opened/closed, the back and forth direction is defined as the direction in which passengers enter/exit the cage, and the up and down direction is defined as the vertical direction, respectively.

The identical components are represented by the same reference numerals, and a detailed description thereof is omitted.

Figure 2:
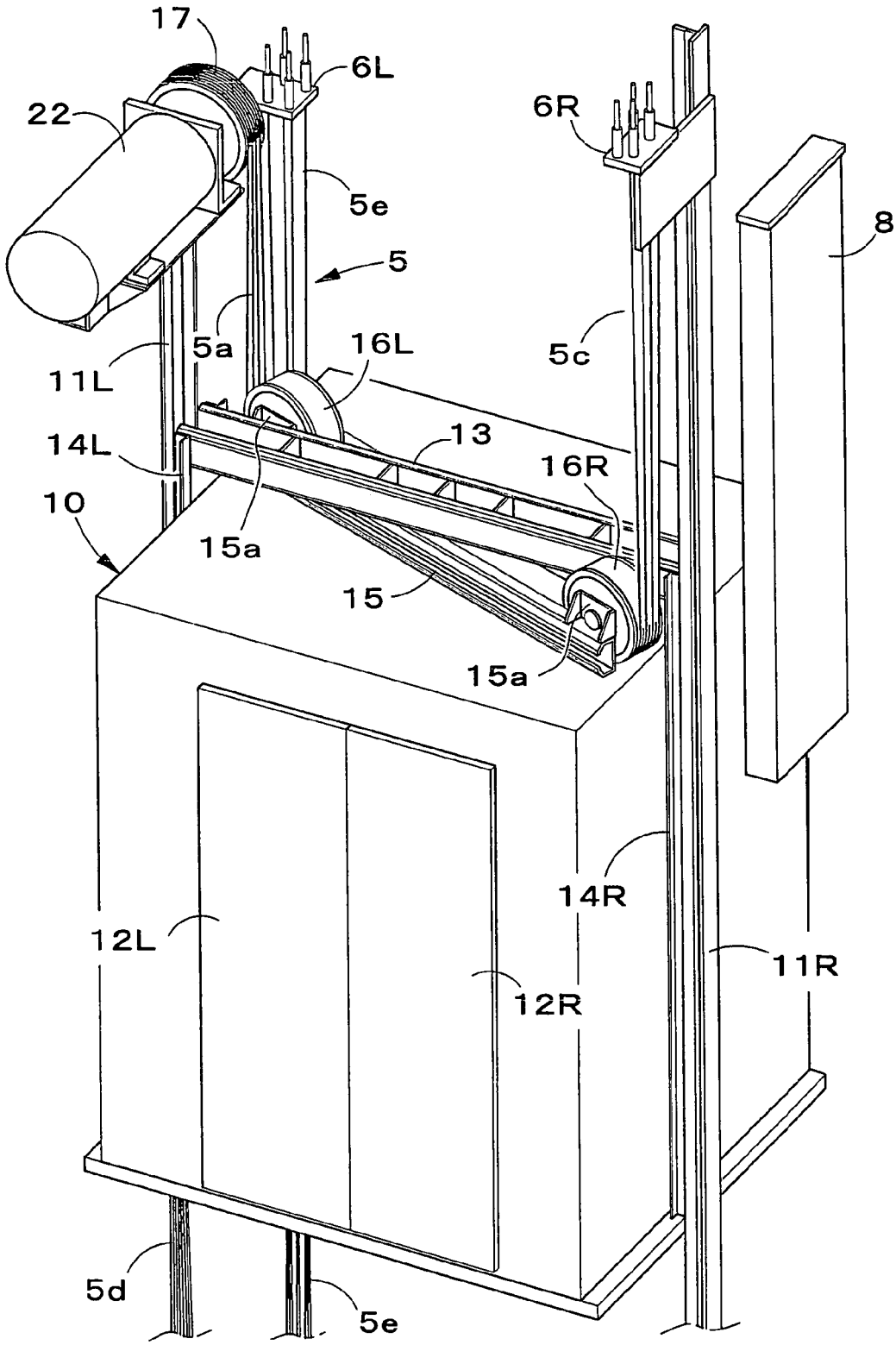
FIG. 2 is an enlarged perspective view of a major part of the machine room-less elevator in FIG. 1.

Firstly, the overall structure of a machineroom-less elevator will be described in detail with reference to FIGS. 1 and 2. A cage 10 is adapted to move vertically in an elevator shaft provided in a building while guided by a pair of right and left cage guide rails 11R and 11L.

A pair of right and left doors 12R and 12L provided on a front side of the cage 10 are opened/closed in the right-and-left direction.

A cage frame to support the cage 10 comprises an upper beam 13 extending horizontally in the right-and-left direction above the cage 10, and a pair of right and left vertical beams 14R and 14L are connected to the right and left ends of the upper beam 13.

The pair of right and left vertical beams 14R and 14L have a pair of front and back vertical members 14*a* and 14*b*, and cage-side guide rails 11R and 11L are interposed between a pair of front and back vertical members 14*a* and 14*b* in the back and forth direction, respectively.

A sheave supporting beam 15 extending in a horizontal plane in an inclined manner with respect to the upper beam 13 is provided leaving a vertical space between the cage 10 and the upper beam 13.

The sheave supporting beam 15 is connected to the upper beam 13 so that a longitudinal center part of an upper surface thereof is tightly fixed to a longitudinal center part of the upper beam 13.

A bracket (a supporting means) 15*a* for rotatably supporting a pair of right and left cage-side sheaves 16R and 16L is provided on upper surface of both ends of the sheave supporting beam 15.

Since the sheave supporting beam 15 is disposed below the rotational axes of the pair of right and left cage-side sheaves 16R and 16L, the upper beam 13 of the cage frame can be disposed close to the upper surface of the cage 10.

Accordingly, a vertical space between a ceiling of the elevator shaft and a highest part of the cage 10, so-called a top clearance, can be reduced.

In addition, the force for hoisting the cage 10 upwardly which is applied to the pair of right and left cage-side sheaves 16R and 16L respectively can be transmitted directly to the lower surface of the upper beam 13 from the upper surface of the sheave supporting beam 15.

A traction sheave 17 disposed in the vicinity of the top end of the left cage guide rail 11L is rotationally driven around the rotational axis extending in the back and forth direction.

One end of the hoist cable 5 wound around the traction sheave 17 comprises a portion 5*a* extending downwardly from the traction sheave 17 to the left cage-side sheave 16L, a portion 5*b* extending horizontally between the pair of right and left cage-side sheaves 16R and 16L, and a portion 5*c* extending upwardly from the right cage-side sheave 16R and fixed to a right hitching device 6R, thus the one end of the hoist cable 5 suspends the cage 10 in a two-to-one roping arrangement.

The other end of the hoist cable 5 wound around the traction sheave 17 comprises a portion 5*d* extending downwardly from the traction sheave 17 toward a counterweight-side sheave 18*a* rotatably supported by an upper part of the counterweight 18, and a portion 5*e* extending upwardly from the counterweight-side sheave 18*a* and fixed to the left hitching device 6L, thus the other end of the hoist cable 5 suspends the counterweight 18 in a two-to-one roping arrangement.

Figure 3:
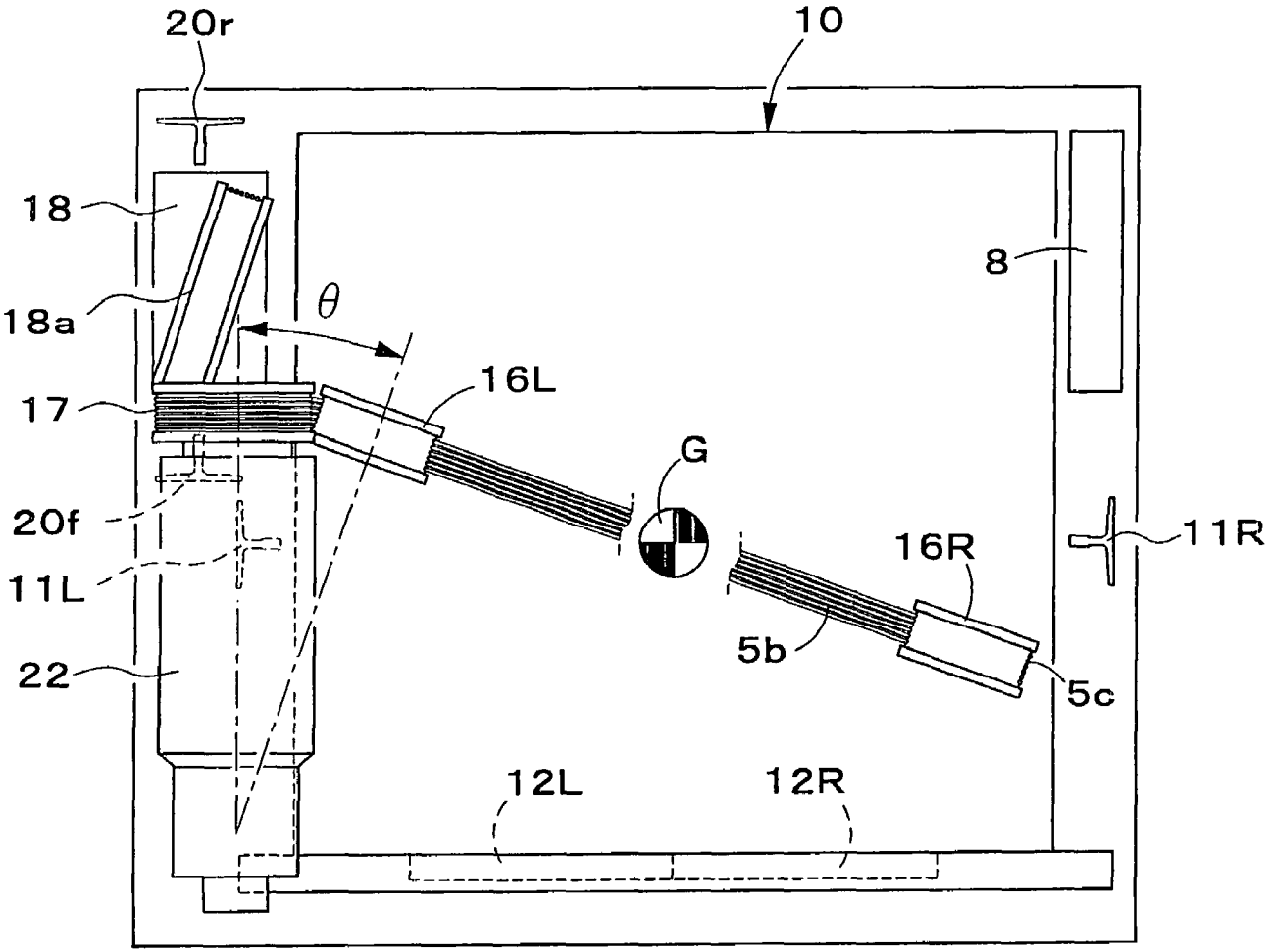
FIG. 3 is a top plan view of the machine room-less elevator shown in FIG. 1.

As shown in FIG. 3, the pair of right and left cage-side sheaves 16R and 16L are disposed symmetrically about the center of gravity "G" of the cage 10 when viewed vertically.

In other words, the pair of right and left cage-side sheaves 16R and 16L are disposed so that the portion 5*b* of the hoist cable 5 extending horizontally between the pair of right and left cage-side sheaves 16R and 16L passes above the center of gravity "G" of the cage 10 when viewed vertically.

Therefore, the gravitational force acting on the cage 10 and that for hoisting the cage 10 upwardly with the hoist cable 5 are substantially coincident with each other, thus the cage 10 can be stably suspended.

In addition, since the pair of right and left cage guide rails 11R and 11L are disposed symmetrically about the center of gravity "G" of the cage 10 in the right-to-left direction, the cage 10 can stably move vertically.

Further, these sheaves can be disposed so that the rotational axis of the traction sheave 17 and the rotational axis of the pair of right and left cage-side sheaves 16R and 16L are parallel to each other.

Alternatively, as shown in FIG. 3, these sheaves can be disposed so that the direction of the rotational axis of the traction sheave 17 is in a close relation to the direction in which the rotational axis of the pair of right and left cage-side sheaves 16R and 16L extends. The angle formed between these axes is preferably in a range between 0° and 45°, more preferably in a range between 0° and 30°, most preferably in a range between 0° and 15°. Thus, the torsion generated in the portion of the hoist cable 5 extending between the traction sheave 17 and the left cage-side sheave 16L can be minimized.

Thus, even when the cage 10 moves to the highest position and the vertical space between the traction sheave 17 and the left cage-side sheave 16L is reduced, the inclination angle of the hoist cable 5 with respect to the grooves of the traction sheave 17 and the left cage-side sheave 16L can be kept small.

Accordingly, any noise and vibrations caused by the contact of the hoist cable 5 comprising ropes with the groove of each sheave can be prevented, and the durability of the hoist cable 5 can be improved.

In addition, the driving unit, the traction sheave, the sheaves to support the cage, the guide rails, etc., can be disposed within the elevator shaft more freely by this configuration in comparison with a conventional elevator in which a flat flexible cable or belt is used, and a rotary shaft of a car-upper or car-lower sheave to support the cage is parallel to a rotary shaft of the traction sheave.

In other words, if the traction sheave 17 and the cage-side sheave 16L are in the above-described relationship, each component can be freely disposed within the elevator shaft, and a system can be freely constituted according to the sectional shape of the cage and the elevator shaft.

Figure 4:
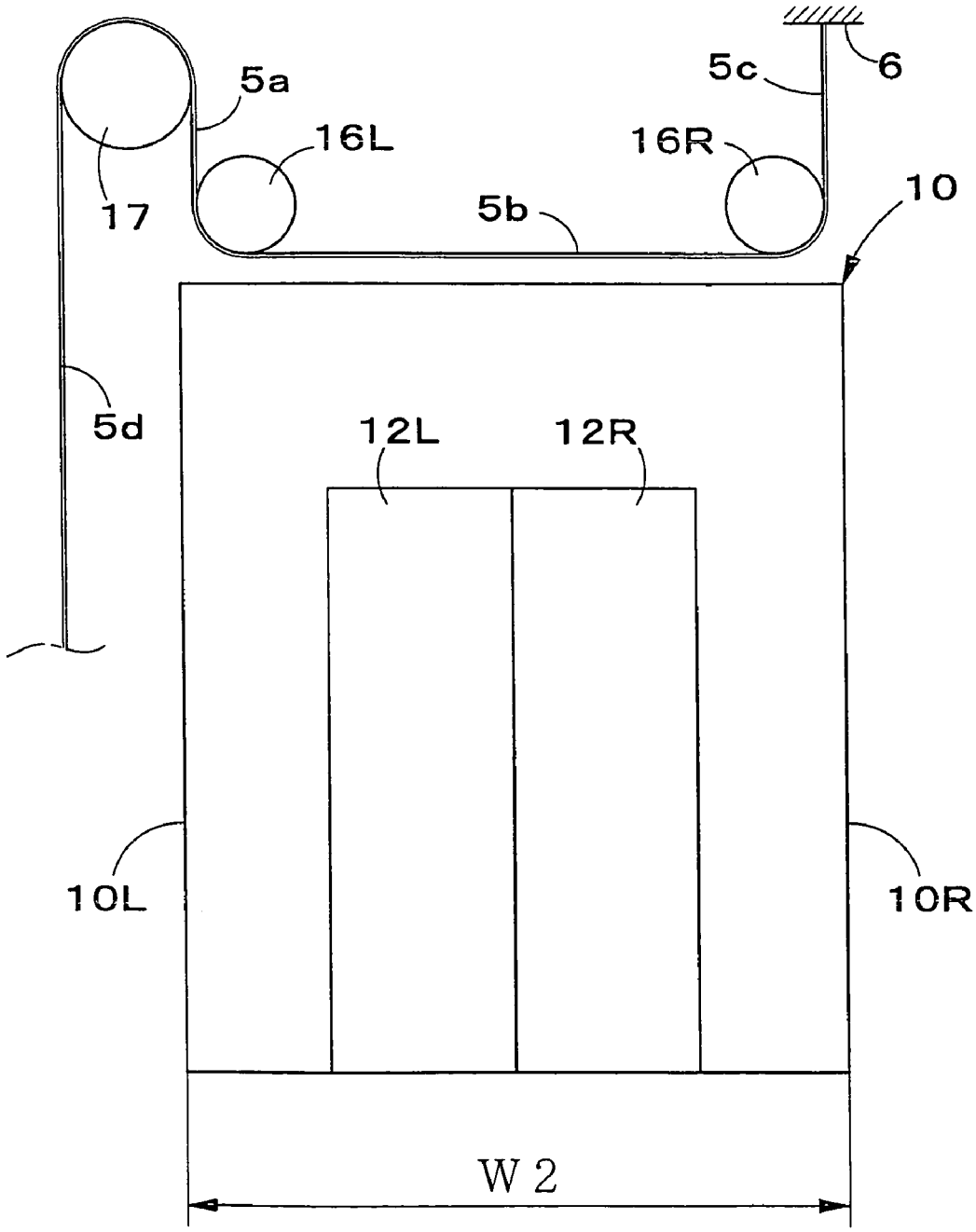
FIG. 4 is a schematic frontal view of the arrangement of a traction sheave and cage-side sheaves.

Further, as shown in FIG. 4, the pair of right and left cage-side sheaves 16R and 16L are disposed in an upper space of the cage 10 in the vicinity of right and left side walls 10R and 10L of the cage 10.

The pit depth in a bottom part of the elevator shaft can be reduced thereby, and the maintenance of not only the traction sheave 17, the pair of right and left cage-side sheaves 16R and 16L, but also a driving unit 22 to rotate the traction sheave 17 and a control device 8 provided in a top space above the elevator shaft to control the operation of the driving unit 22 can be mostly performed by an operator on the upper space of the cage 10.

In addition, since the hoist cable 5 is not extended along the right and left side walls 10R and 10L of the cage 10, the cage 10 can be expanded so that the left side wall 10L of the cage 10 is located below the traction sheave 17.

When the horizontal cross section of the elevator shaft is constant, a larger space for the cage 10 can be secured.

In other words, when the horizontal cross section of the cage 10 is constant, the horizontal cross section of the elevator shaft can be reduced.

Further, since the left cage-side sheave 16L is located immediately below the traction sheave 17, the winding angle of the hoist cable 5 to the traction sheave 17 can be set to be large, and the hoist cable 5 can be reliably friction-engaged with the traction sheave 17.

Still further, since no deflector sheave needs to be interposed between the traction sheave 17 and the left cage-side sheaves 16L, a space in the vertical direction between the ceiling of the elevator shaft and the cage 10, so-called the top clearance, can be reduced.

In addition, since no cage-side sheaves or hoist cable are disposed below the cage 10, a buffer provided on a bottom part of the elevator shaft can be disposed facing the center position of the bottom side of the cage 10.

Figure 5:
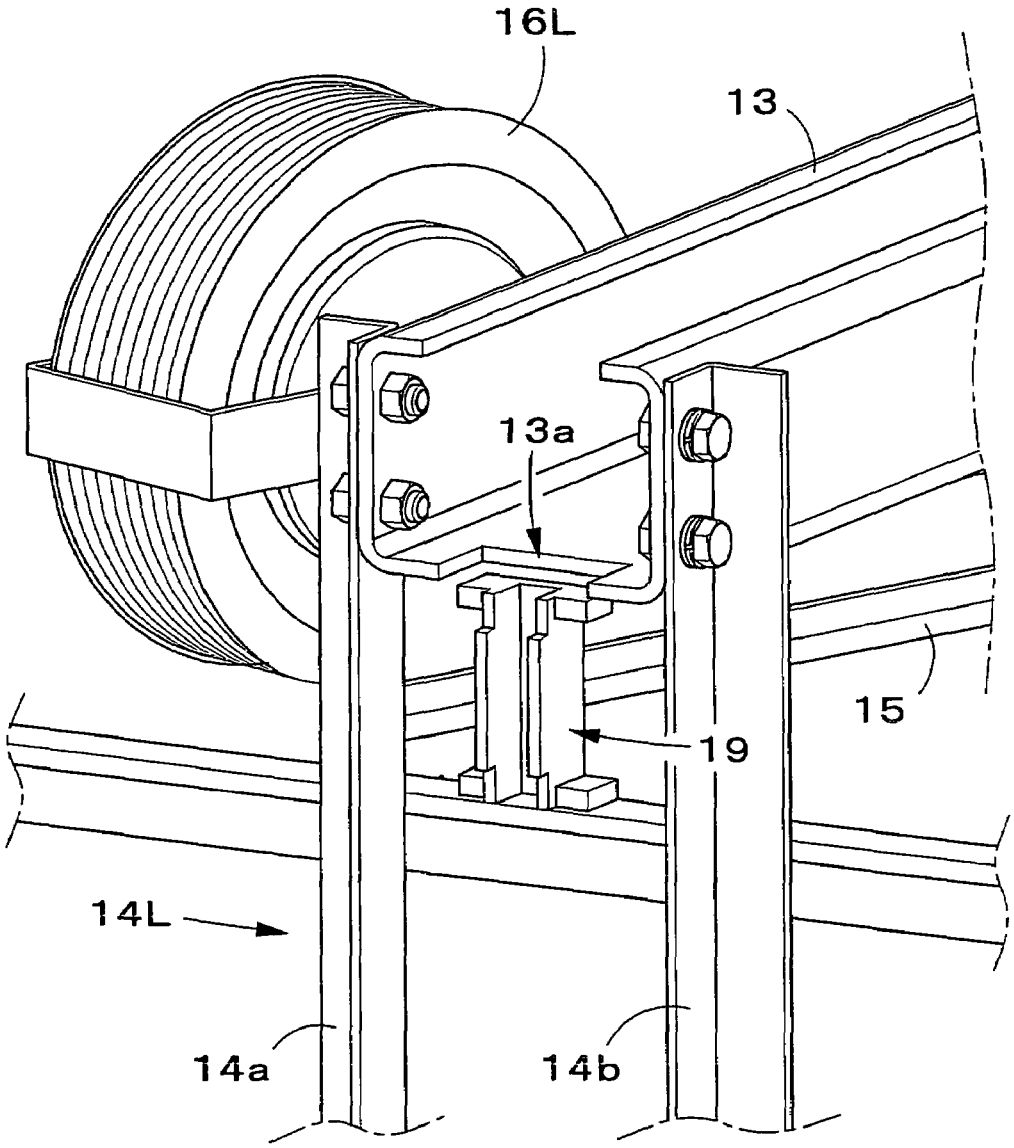
FIG. 5 is a perspective view of a guide shoe.

As shown in FIG. 5, a guide shoe 19 serving as a guide unit is disposed between the lower side of the upper beam 13 and the upper side of the cage 10, and between the pair of front and back vertical members 14*a* and 14*b*.

The guide shoe 19 is not protruded above the upper beam 13 like in a conventional machine room-less elevator, and the cage 10 can move to the position closest to the highest ends of the pair of right and left cage guide rails 11R and 11L.

Therefore, the space in the vertical direction between the ceiling of the elevator shaft and the cage 10, i.e., the top clearance, can be reduced.

Figure 6:
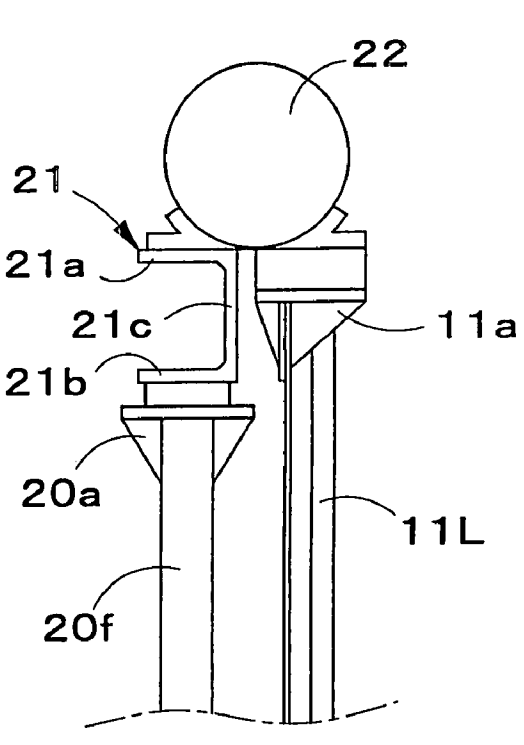
FIGS. 6A and 6B are a side view and a frontal view of the supporting state of a driving unit, respectively.
Figure 6:
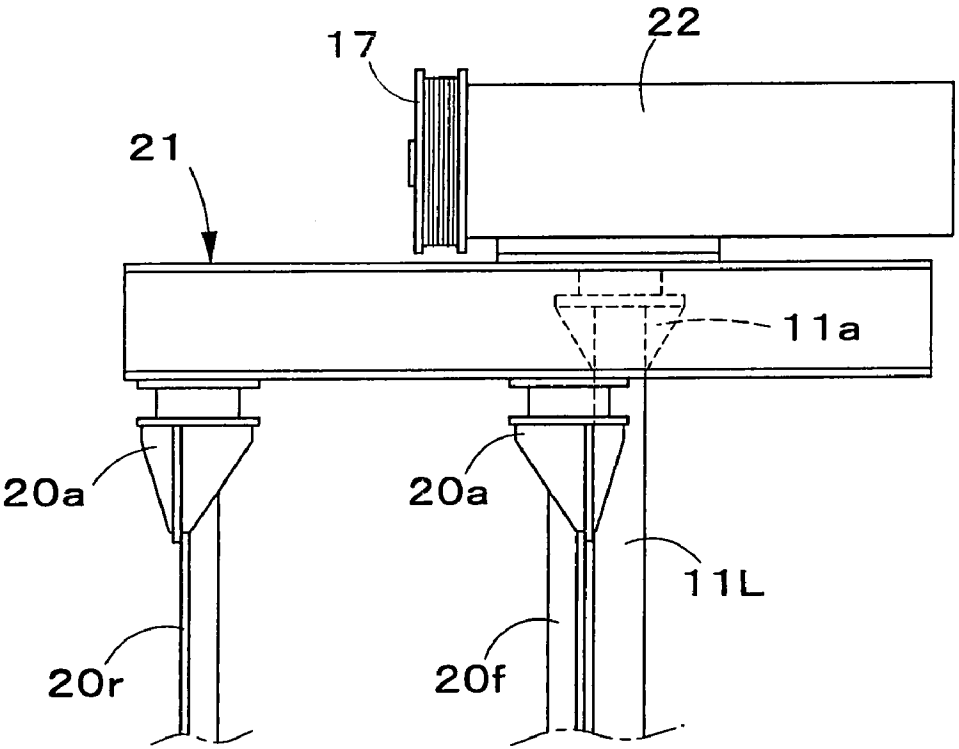
Figure 7:
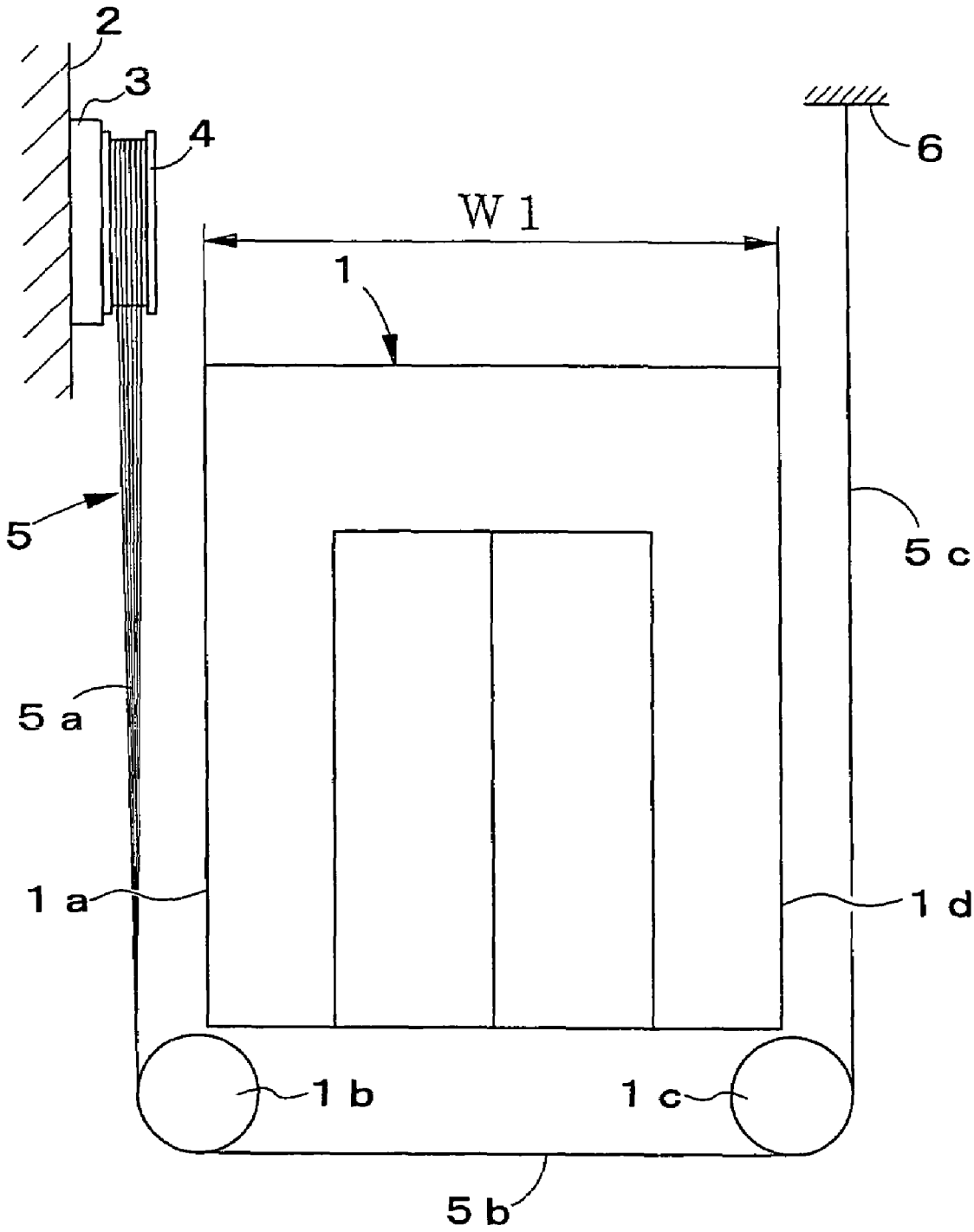
FIG. 7 is a schematic frontal view of a conventional machine room-less elevator.
Figure 8:
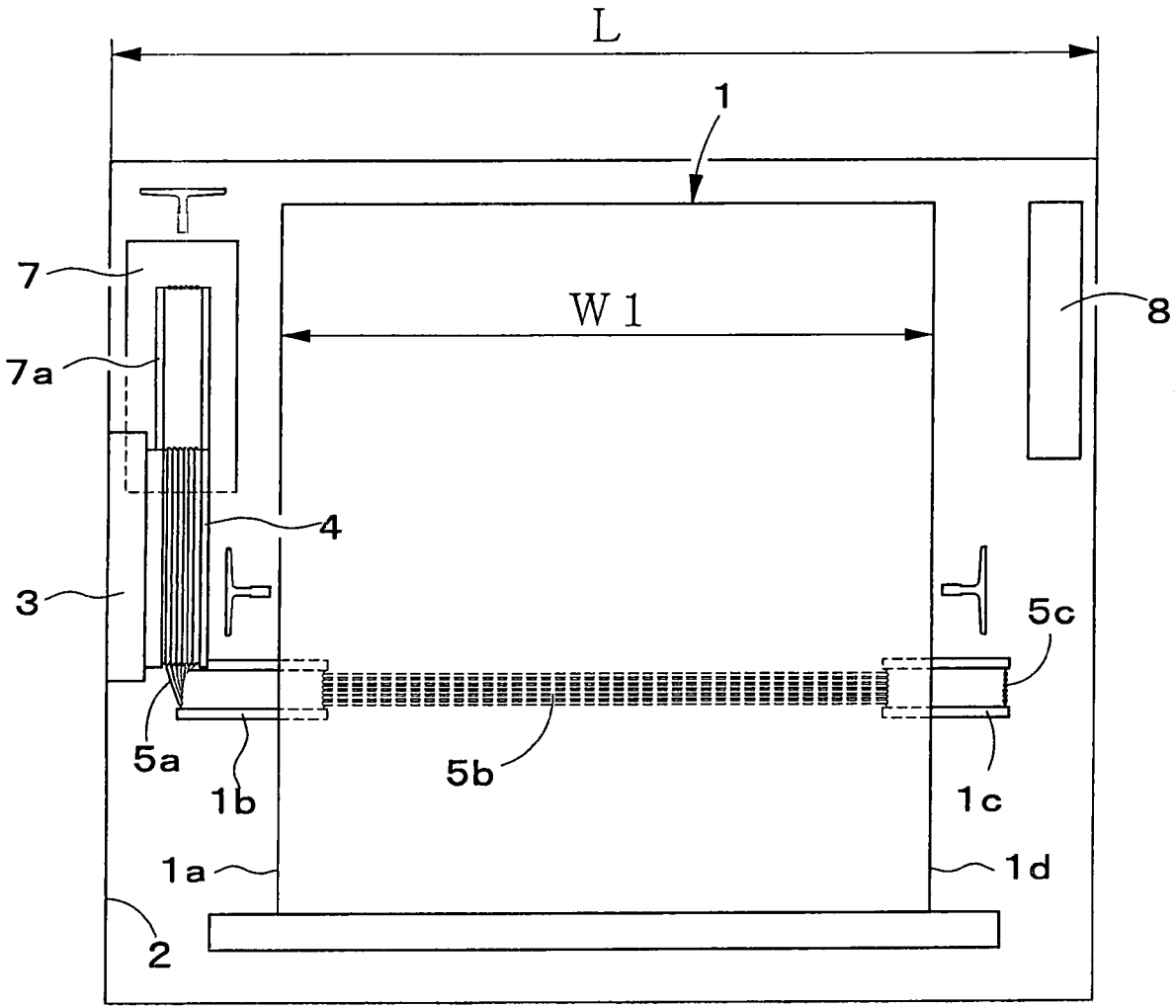
FIG. 8 is a top plan view of the machine room-less elevator shown in FIG. 7.

As shown in FIG. 6, a supporting frame 21 of a U-shaped section having a pair of upper and lower horizontal walls 21*a* and 21*b* and a vertical wall 21*c* to connect the horizontal walls to each other is stretched between upper ends of a pair of front and back counterweight guide rails 20*f* and 20*r* to guide the counterweight 18 in an elevating/lowering manner so as to be extended horizontally in the back and forth direction, and fixed by the brackets 20*a*.

In addition, the driving unit 22 to rotate the traction sheave 17 is placed between an upper end face of the left cage guide rail 11L and an upper side of the supporting frame 21.

Since the left cage guide rail 11L is extended more upwardly than the pair of the front and back counterweight guide rails 20*f* and 20*r* by the vertical dimension of the supporting frame 21, the cage 10 can move more upwardly to the ceiling of the elevator shaft.

In addition, the driving unit 22 can be stably supported by the two counterweight guide rails 20*f* and 20*r*, and the cage guide rail 11L.

Still further, the driving unit 22 is disposed so that the center of gravity is located above the position closer to the cage guide rail 11L side than aback side of the horizontal wall 21*a* of the supporting frame 21, and the bending moment around the axis extending in the longitudinal direction of the supporting frame 21 does not act on the supporting frame 21.

Therefore, even when the weight of the driving unit 22 acts, both the counterweight guide rails 20*f* and 20*r* and the cage guide rail 11L are not bent at the same time.

In addition, since the left hitching device 6L is disposed on a supporting plate fixed to the supporting frame 21, the tension acting on an end of the counterweight 18 side of the hoist cable 5 is supported by three guide rails in total, and the bending of each guide rail can be minimized.

An embodiment of the machine room-less elevator of the present invention is described above in detail. The present invention is not limited to the above embodiment, and needless to say, various kinds of modification can be added to the scope of the present invention.

For example, in the above embodiment, the cage 10 is suspended by using the pair of right and left cage-side sheaves 16R and 16L, which the cage 10 can be suspended only by the left cage-side sheaves 16L.

Further, the sectional shape of the supporting frame 21 to support the driving unit 22 can be H-shape or I-shape in addition to U-shape.

In the above embodiment, the counterweight 18 is disposed so as to move vertically at the left side of the cage 10, while it may be disposed so as to move vertically at the back side of the cage 10.

As described above, in the machine room-less elevator of the present invention, the cage-side sheaves are provided in an upper space of the cage, and the pit depth in the bottom part of the elevator shaft can be reduced.

What is claimed is:

1. A machine room-less elevator comprising:

a cage adapted to move vertically in an elevator shaft guided by a pair of right and left guide rails;

a traction sheave disposed within a top portion of the elevator shaft and rotationally driven around the rotational axis extending in a back and forth direction;

a driving unit for rotating the traction sheave;

a cage frame for supporting the cage and having an upper beam horizontally extending in a left and right direction above an upper surface of the cage;

a cage-side sheave supporting beam for supporting a pair of right and left cage-side sheaves at both ends thereof, respectively, said cage-side sheave supporting beam being inserted in a space between the upper beam and an upper surface of the cage in a horizontal manner, and connected to a center portion of the upper beam with a center portion thereof;

a hoist cable including a plurality of ropes wound around the traction sheave, said hoist cable suspending the cage by one end thereof through the pair of right and left cage-side sheaves and suspending a counterweight by another end thereof, wherein said pair of right and left cage-side sheaves are disposed to rotate around rotational axes thereof extending parallel to or in close proximity with a rotational axis of the traction sheave, respectively.

2. A machine room-less elevator according to claim 1, wherein said pair of right and left cage-side sheaves are disposed in a vicinity of right and left side walls of the cage, respectively, and are rotatable around rotational axes extending parallel to each other.

3. A machine room-less elevator according to claim 2, wherein said pair of right and left cage-side sheaves are disposed in a projected area of the cage when viewed vertically in the elevator shaft.

4. A machine room-less elevator according to claim 2, wherein said right and left cage-side sheaves are disposed symmetrically about a center of gravity of the cage when viewed vertically.

5. A machine room-less elevator according to claim 1, further comprising:

a pair of right and left cage guide rails; and a guide unit for guiding vertical movement of the cage by a contact with said pair of guide rails, said guide unit being fixed to an upper portion of the cage frame, wherein said cage frame has at least one pair of front and back members extending vertically along and sandwiching in a back and forth direction one of the guide rails, and and said guide unit is disposed between the pair of front and back members in an area between a lower surface of the upper beam and an upper surface of the cage.

6. A machine room-less elevator according to claim 1, wherein at least a part of the driving unit overlaps a projected area of the cage when viewed in a vertical direction.

7. A machine room-less elevator according to claim 6, further comprising:

a pair of back and forth counterweight-side guide rails for guiding the vertical movement of the counterweight; and a supporting frame bridged between top ends of the pair of back and forth counterweight-side guide rails and horizontally extending in a back and forth direction, said supporting frame having a pair of upper and lower horizontally extending walls and a vertically extending wall for connecting the horizontally extending walls, wherein said driving unit is disposed and fixed on an upper surface of the supporting frame and on a top end of the cage-side guide rail disposed in a vicinity of the counterweight-side guide rails.

8. A machine room-less elevator according to claim 7, wherein said driving unit is disposed so that the center of gravity thereof is located above the position closer to the cage-side guide rail than a back side of the vertical wall of the supporting frame.

9. A machine room-less according to claim 7, wherein said other end of the hoist cable is fixed to the hitching device continuously provided to the supporting frame.

* * * * *